US012593945B2

(12) United States Patent
Hott

(10) Patent No.: US 12,593,945 B2
(45) Date of Patent: Apr. 7, 2026

(54) SYSTEM AND METHOD FOR PROVIDING A HOT TOWEL

(71) Applicant: Nicholas J. Hott, Lansing, MI (US)

(72) Inventor: Nicholas J. Hott, Lansing, MI (US)

( * ) Notice: Subject to any disclaimer, the term of this patent is extended or adjusted under 35 U.S.C. 154(b) by 693 days.

(21) Appl. No.: 17/879,551

(22) Filed: Aug. 2, 2022

(65) Prior Publication Data

US 2023/0037574 A1 Feb. 9, 2023

Related U.S. Application Data

(60) Provisional application No. 63/228,966, filed on Aug. 3, 2021.

(51) Int. Cl.

| | |
|---|---|
| ***A47K 10/02*** | (2006.01) |
| ***B65D 33/25*** | (2006.01) |
| ***B65D 75/00*** | (2006.01) |

(52) U.S. Cl.

CPC ..... *A47K 10/02* (2013.01); *B65D 33/2508* (2013.01); *B65D 75/008* (2013.01); *B65D 2207/00* (2013.01)

(58) Field of Classification Search

CPC .. A47K 10/02; B65D 33/2508; B65D 75/008; B65D 2207/00

USPC ..... 126/263

See application file for complete search history.

(56) References Cited

U.S. PATENT DOCUMENTS

| | | | | |
|---|---|---|---|---|
| 4,117,309 | A * | 9/1978 | Cayley | A47K 10/06 392/407 |
| 5,935,486 | A * | 8/1999 | Bell | B65D 81/3484 126/263.01 |
| 7,022,945 | B1 * | 4/2006 | Western | A47K 10/42 126/265 |
| 11,696,662 | B1 * | 7/2023 | Daniels, Jr. | A47K 10/02 15/104.001 |
| 2006/0003912 | A1 * | 1/2006 | Lindsay | A47L 13/51 510/267 |
| 2014/0026469 | A1 * | 1/2014 | Balcarek | A01M 1/2094 43/132.1 |
| 2018/0346226 | A1 * | 12/2018 | Burke | B65D 75/563 |
| 2023/0294901 | A1 * | 9/2023 | Mishkin | B65D 77/04 426/109 |

FOREIGN PATENT DOCUMENTS

| | | | | |
|---|---|---|---|---|
| CN | 105307549 A * | 2/2016 | | A47L 13/16 |
| WO | WO-2008069868 A1 * | 6/2008 | | A47K 10/421 |

* cited by examiner

*Primary Examiner* — Allen R. B. Schult
*Assistant Examiner* — William C Weinert
(74) *Attorney, Agent, or Firm* — Ballard Spahr LLP

(57) ABSTRACT

A system comprises a container, a water-activated heating element, and a towel. Water can be poured into the container to activate the water-activated heating element. The towel can be placed in the container with the activated water-activated heating element.

20 Claims, 7 Drawing Sheets

SYSTEM AND METHOD FOR PROVIDING A HOT TOWEL

CROSS-REFERENCE TO RELATED APPLICATIONS

This application claims priority to and the benefit of the filing date of U.S. Provisional Patent Application No. 63/228,966, filed Aug. 3, 2021, the entirety of which is hereby incorporated by reference herein.

FIELD

This application relates to devices, systems, and methods for preparing a hot towel.

BACKGROUND

Hot towels can be desirable in a variety of environments and situations. However, typical methods for providing a hot towel require a heating device, such as an oven or microwave, or a supply of hot water, such as water heated in a kettle. Accordingly, many situations arise in which a hot towel is desirable but unavailable.

SUMMARY

Described herein, in one aspect, is a system for providing a hot towel. The system can comprise a towel and a water-activated heating element. The system can further comprise a container. The container can optionally comprise a vessel and a lid. In other aspects, the container can comprise a pouch.

In another aspect, a method can comprise pouring a quantity of water into a container to activate a water-activated heating element and placing the towel into the container.

Additional advantages of the disclosed apparatuses, systems, and methods will be set forth in part in the description that follows, and in part will be obvious from the description, or may be learned by practice of the invention. The advantages of the disclosed apparatuses, systems, and methods will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the disclosed apparatuses, systems, and methods will become more apparent in the detailed description in which reference is made to the appended drawings wherein.

DETAILED DESCRIPTION

Figure 1:
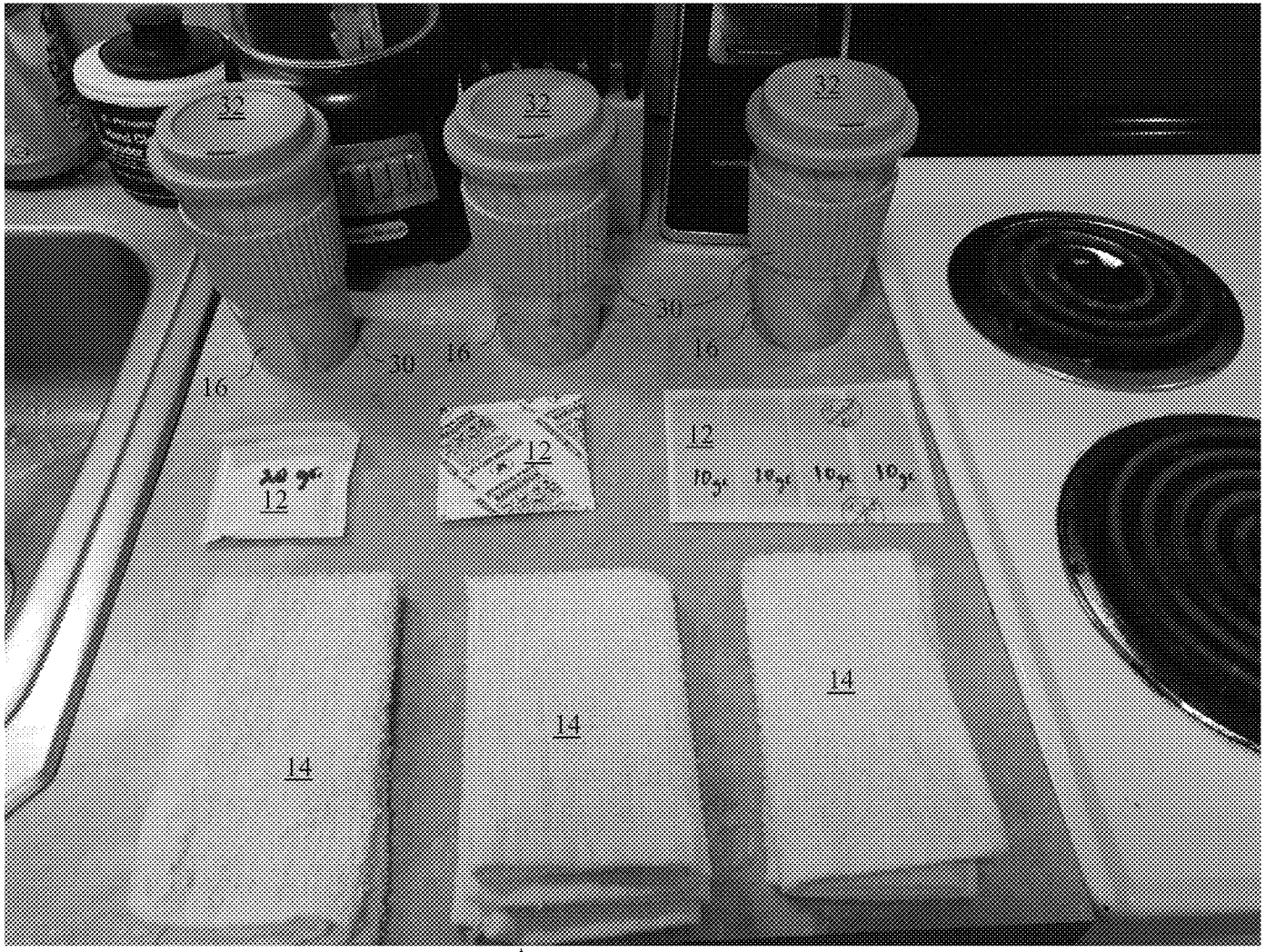
FIG. 1 is a perspective view of a system for providing a hot towel as disclosed herein.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a water-activated heating element" can refer to one or more of such water-activated heating elements, and so forth.

All technical and scientific terms used herein have the same meaning as commonly understood to one of ordinary skill in the art to which this invention belongs unless clearly indicated otherwise.

As used herein, the terms "optional" or "optionally" mean that the subsequently described event or circumstance may or may not occur, and that the description includes instances where said event or circumstance occurs and instances where it does not.

As used herein, the term "at least one of" is intended to be synonymous with "one or more of." For example, "at least one of A, B and C" explicitly includes only A, only B, only C, and combinations of each.

Ranges can be expressed herein as from "about" or "approximately" one particular value, and/or to "approximately" another particular value. When such a range is expressed, another aspect includes from the one particular value and/or to the other particular value. Similarly, when values are expressed as approximations, by use of the antecedent "approximately," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about" or "approximately," it is contemplated that values within up to 15%, up to 10%, up to 5%, or up to 1% (above or below) of the particularly stated value can be included within the scope of those aspects.

The word "or" as used herein means any one member of a particular list and also includes any combination of members of that list.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Disclosed herein, with reference to FIGS. 1-4 is system 10 for providing a hot towel. As used herein, a "hot towel" can be a towel having a temperature that is elevated above the ambient temperature. For example, the hot towel can have a temperature that is soothingly hot (not scalding) for cleaning or refreshing. The system 10 can comprise a water-activated heating element 12 and a towel 14. In various aspects, the towel 14 can comprise terrycloth. In further aspects, the towel 14 can comprise microfiber (e.g., natural microfiber cotton). In other aspects, the towel 14 can comprise paper. In other aspects, the towel 14 can comprise any suitable material.

The towel 14 can optionally be about 12 inches in length by about 12 inches in width. In various optional aspects, the towel 14 can have a length from about 6 inches to about 12 inches, from about twelve inches to about 16 inches, or from 16 inches to about 24 inches, or more than 24 inches. In various optional aspects, the towel 14 can have a width from about 6 inches to about 12 inches, from about 12 inches to about 16 inches, or from 16 inches to about 24 inches or more. In further aspects, the towel 14 can be sized to be received within a container as further disclosed herein. Thus, in some optional aspects, it is contemplated that the size of the towel 14 can be determined by the size of the container. In some optional aspects, the towel 14 can be impregnated with one or more additives. The additive can comprise, for example, a moisturizer, a fragrance, or an antimicrobial substance.

The water-activated heating element 12 can comprise magnesium, iron, and a salt (e.g., sodium chloride, calcium chloride, or any suitable salt that is configured to provide electrolytes when in the presence of water to catalyze reaction between the magnesium and water). Such water-activated heating elements are conventionally manufactured for heating food (e.g., meals ready to eat, or MREs). Optionally, the water-activated heating element 12 can be at least a 10 gram heating element, at least a 15 gram heating element, at least a 20 gram heating element, at least a 25 gram heating element, at least a 30 gram heating element, at least a 40 gram heating element, or at least a 60 gram heating element. It is contemplated that a 20 gram water-activated heating element can be sufficient to heat the towel to a desirable temperature. For example, the water-activated heating element 12 can have sufficient active elements to heat the towel to at least 120° F., or at least 140° F., or at least 160° F., or at least 180° F. Optionally, the water-activated heating element 12 can be wrapped in an airtight packaging 13 (FIG. 7) (e.g., plastic wrap) in order to prevent moisture (e.g., in the air) from prematurely activating the heating element or degrading is efficacy. Optionally, the water-activated heating element 12 can further comprise a water-permeable packaging (e.g., mesh) within which active elements (e.g., magnesium and salt) of the water-activated heating element are disposed. Thus, the water-permeable packaging can contain the active elements of the water-activated heating element 12 so that the active elements of the water-activated heating element can be contained and kept separate from the towel 14 and can be easily disposed of.

The system 10 can further comprise a container 16 defining an interior 18. For example, the water-activated heating element 12 and the towel 14 can be positioned within the interior 18 of the container 16. In some aspects, the water-activated heating element 12 can comprise packaging (e.g., water-activated heating elements provided in water-permeable packaging and, optionally, further wrapped in airtight packaging 13 (FIG. 7)). In other optional aspects, it is contemplated that the water-activated heating element 12 can coat at least a portion of the interior 18 of the container 16.

Figure 5:
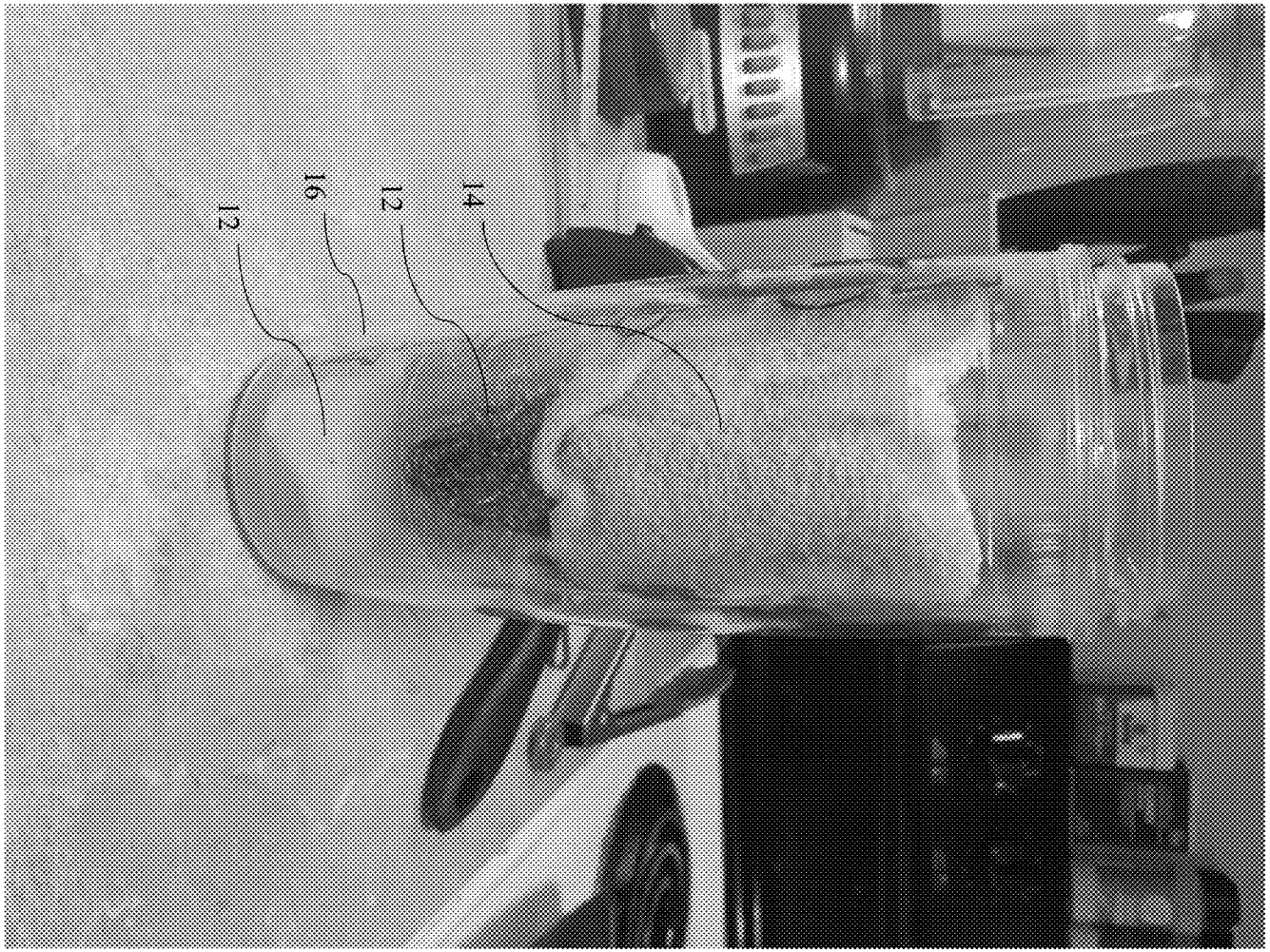
FIG. 5 is a perspective view of a system for providing a hot towel as disclosed herein.

Optionally, a spacer 20 can be positioned within the interior of the container 16 between the water-activated heating element 12 and the towel 14 to maintain a spaced relationship between the water-activated heating element and the towel. In this way, the spacer 20 can inhibit the water-activated heating element from burning, melting, or otherwise overheating and damaging the towel. For example, the spacer 20 can divide the interior of the container into a water-activated heating element space 18*a* and a towel space 18*b*. In some aspects, the spacer can comprise a top end 22, a bottom end 24, and a central opening 26 that extends between the top end and the bottom end. The towel 14 can bias against the top end 22 of the spacer. Optionally, the water-activated heating element 12 can be beneath the bottom end 24 of the spacer 20. In further optional aspects, the water-activated heating element 12 can be disposed within the central opening 26 of the spacer. The central opening 26 of the spacer 20 can allow steam and heat to pass therethrough to heat the towel 14. The spacer can optionally comprise polymer (e.g., optionally, polyvinylchloride (PVC)). In other aspects, the spacer 20 can comprise a sheet defining one or more apertures that conduct heated water (e.g., steam) therethrough. The sheet can optionally comprise polymer (e.g., silicone). In still further aspects and as shown in FIG. 5, the spacer 20 can comprise a mesh (e.g., stainless steel wool or other bundled filaments). In various aspects, the mesh can be shaped as a ball or a disc. In some optional aspects, the mesh ball or disc can have a diameter of less than 3 inches, or about 2.5 inches. The mesh can optionally have a thickness of at least one quarter inch, at least one half inch, between one half inch and two inches.

Optionally, the spacer 20 can define a taper between the top end 22 and the bottom end 24. Thus, the central opening 26 can have a larger cross section at the top end than at the bottom end in planes perpendicular to an axis extending between the top end and the bottom end. In this way, the spacer 20 can be receivable into a container 20 having a taper between the top and bottom.

In some aspects, the container 16 can comprise a vessel 30 and a lid 32. Optionally, the lid 32 can threadedly couple to the vessel 30. In this way, pressure within the container does not cause the lid 32 to undesirably eject from the vessel 30. The container 16 can be, for example, an insulated tumbler (e.g., a stainless steel double-walled tumbler). The container 16 can comprise a seal (e.g., a polymer seal) that inhibits leaking between the vessel 30 and the lid 32. In various optional aspects, the container can have a volume of at least 350 mL (12 ounces), about 350 mL (12 ounces), about 475 mL (16 ounces), about 590 mL (20 ounces), about 825 mL (28 ounces), or between about 475 and about 825 mL (about 16 ounces and about 28 ounces). In various optional aspects, the container can comprise single wall polymer, double wall polymer, single or double wall aluminum, single wall stainless steel, or double wall stainless steel. In various further optional aspects, the container can be a coffee travel mug or bottle shaped (e.g., a water bottle).

The lid 32 can define a vent 34 (e.g., one or more apertures) that can relieve steam pressure that builds within the container 16.

Figure 6:
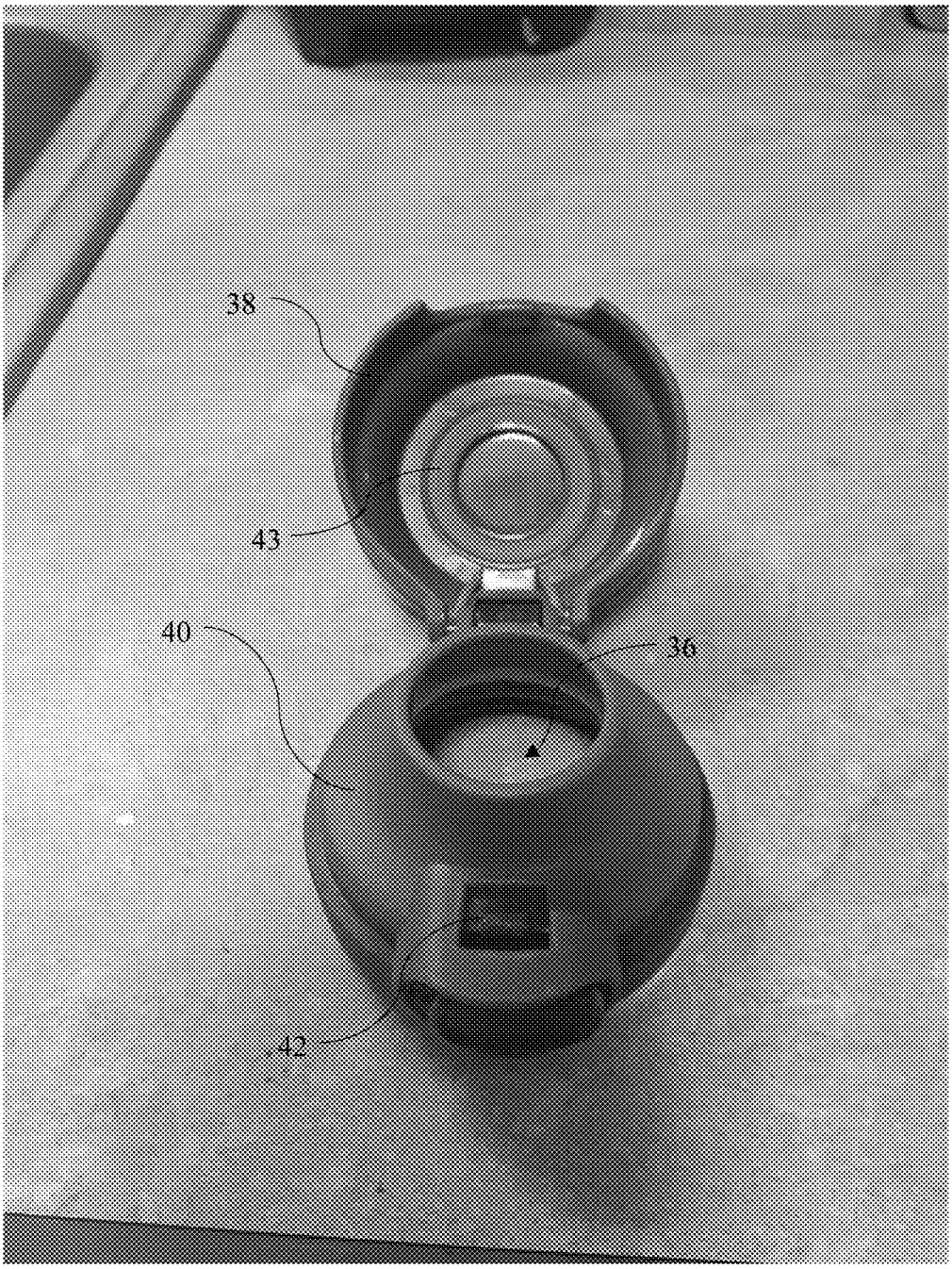
FIG. 6 is a perspective view of a lid as disclosed herein.

The lid 32 can define a main opening 36 through which the towel 14 can optionally be removed. The lid 32 can comprise a cover 38 can be configured to cover the main opening 36. Optionally, the cover 38 can be pivotably coupled to a main body 40 of the lid. For example, the cover 38 can be pivotable between a first position (FIG. 3) that covers the top opening and a second position (FIG. 4) that is pivoted away from the top opening. In some optional aspects, the lid 32 can further comprise a latch 42 that inhibits movement of the cover from the first position. In some optional aspects, the latch 42 can comprise a snap or detent that retains the cover in the first position. Referring to FIG. 6, the latch 42 can optionally be a push button or a slide. Optionally, the cover 38 can be spring biased toward an open position so that the cover 38 moves to the open position upon release of the latch 42. Although FIG. 6 shows a tapered neck and a main opening 36 having a narrower diameter than the lower end of the lid, it is contemplated that in further aspects, the main opening 36 can be substantially the same diameter (e.g., within 20% or within 15% or within 10% of the diameter) of the lower end of the lid that couples to the top end of the vessel. For example, the main opening 36 can have a diameter of at least 2 inches, or at least 2.5 inches, at least 2.75 inches (e.g., 2.75 inches-3 inches), or about 3 inches or more. In another example, the main opening 36 can have a diameter from about 2 inches to about 5 inches, such as from about 2 inches to about 3.5 inches. Optionally, a seal 43 can be positioned between the cover 38 and the main body 40 of the lid 32.

In some aspects, the container 16 can be flexible. For example, referring to FIGS. 7-8, the container 16 can optionally comprise a pouch 50. The pouch 50 can optionally be collapsible to lie flat. The pouch 50 can comprise polymer. The pouch 50 can optionally have an opening 52 and a press seal zipper closure 54 (e.g., a ZIPLOC® SMART ZIP PLUS seal) that is configured to close the opening 52. The pouch 50 can optionally have an expandable base 56 to permit the pouch to stand vertically (e.g., with the opening 52 positioned at a top of the pouch). In some aspects, the pouch 50 can be insulated. For example, the pouch 50 can comprise a metallic or other thermally reflective layer.

The system 10 can further comprise a utensil 60 (e.g., a pair of tongs) that can be used to remove the towel, once hot, from the container. The utensil 60 can comprise synthetic material (e.g., polymer) or natural material (e.g., bamboo). In other aspects, the utensil 60 can comprise metal.

The system 10 can further comprise a quantity of water 44. The quantity of water 44 can be provided in a pre-use condition in which it is separated from the water-activated heating element. For example, the quantity of water 44 can be provided in capsule 46 (FIG. 6), such as, for example, a bag (e.g., a single use bag or a reusable, resealable bag) or a cartridge. Thus, in some aspects, the system 10 can be provided as a container having therein a towel, a water-activated heating element, a quantity of water within a capsule and, optionally, a spacer. Optionally, a plurality of water-activated heating elements can be provided to enable multiple uses of the system 10.

The system 10 can be used to provide a hot towel. In some aspects, the water-activated heating element 12 can be activated in the container 16. For example, the water-activated heating element 12 can be positioned within the container 16, and water can be poured into the container 16 onto the water-activated heating element. In further aspects, water can be poured into the container 16, and the water-activated heating element 12 can then be positioned within the container 16.

The towel 14 can be positioned within the container 16 as the water-activated heating element 12 heats the water. Optionally, prior to pouring water into the container 16, the towel 14 can be removed from the container. The water can be poured into the container, and the towel can be replaced back in the container. For example, the towel 14 can be folded, rolled, wadded, or any combination thereof, and then positioned in the container 16. Optionally, the towel can be positioned on or above the water. In other aspects, the towel 14 can be positioned in the container 16, and the water can subsequently be added to the container.

In some aspects, a first quantity of water can be provided into the container. For example, at least 40 mL, for example at least 50 mL, at least 75 mL, at least 100 mL, or at least 120 mL (optionally, about 50 mL, or about 120 mL) of water can be poured into the container. In some aspects, a second quantity of water can be provided into the container. For example, the first quantity of water can be poured into the container, the towel can be positioned within the container, and the second quantity of water can be poured into the container on top of the towel. Optionally, the second quantity of water can be from about 40 mL to about 200 mL, for example from about 50 mL to about 150 mL, or from about 50 mL to about 100 mL, or about 100 mL. Accordingly, in some aspects, the first quantity of water can generate steam to heat the towel, and the second quantity of water can dampen the towel.

After waiting for a duration (e.g., at least one minute, at least 2 minutes, at least 3 minutes, at least 5 minutes, from one minute to 2 minutes, or about 5 minutes), the towel 14 can be removed from the container. Optionally, the towel 14 can be removed when at least a portion (optionally, all) of the towel reaches a temperature at or above a temperature of 120° F. For example, it is contemplated that the towel 14 can be sufficiently warm to feel good without burning the user between a temperature of 140° F. and 180° F. Optionally, the towel 14 can be removed from the container and then allowed to cool to a desired temperature (e.g., less than 180° F., or from about 140° F. to about 180° F.).

The water can be emptied from the container 16, and the water-activated heating element can be allowed to dry. In some optional aspects, the water-activated heating element can be reused. For example, another quantity of water can be applied to the water-activated heating element within the container, and the towel can be positioned within the container. In further aspects, an unused water-activated heating element can replace a used water-activated heating element, and the container can be reused to heat the same or another towel.

In one exemplary aspect, the towel 14 can be removed from the container 16. For example, the lid can be removed to allow the towel to be removed from the container, or the towel can be removed through the opening in the lid. The water-activated heating element 12 can be removed from its packaging. The water-activated heating element 12 can be combined with water, such as, for example, at least 40 mL, at least 50 mL, at least 75 mL or at least 100 mL, or at least 120 mL, or about 120 mL, or from about 40 mL to about 100 mL, or from about 40 ml to about 150 ml (optionally, about 50 mL). The towel 14 can be replaced back in the container, optionally in rolled form). The towel 14 can then be wet with an additional quantity of water (e.g., optionally, from about 40 mL to about 200 mL, for example from about 50 mL to about 150 mL, or from about 50 mL to about 100 mL, or about 100 mL). The lid of the container can be coupled (e.g., threadedly coupled) to the vessel, or the cover 38 can be moved to the first position to cover the opening of the lid. The user can wait until the towel becomes hot (e.g., about 5 minutes). The lid can be removed from the vessel, or the cover 38 can be opened to the second position, and the towel can be removed from the container.

Figure 2:
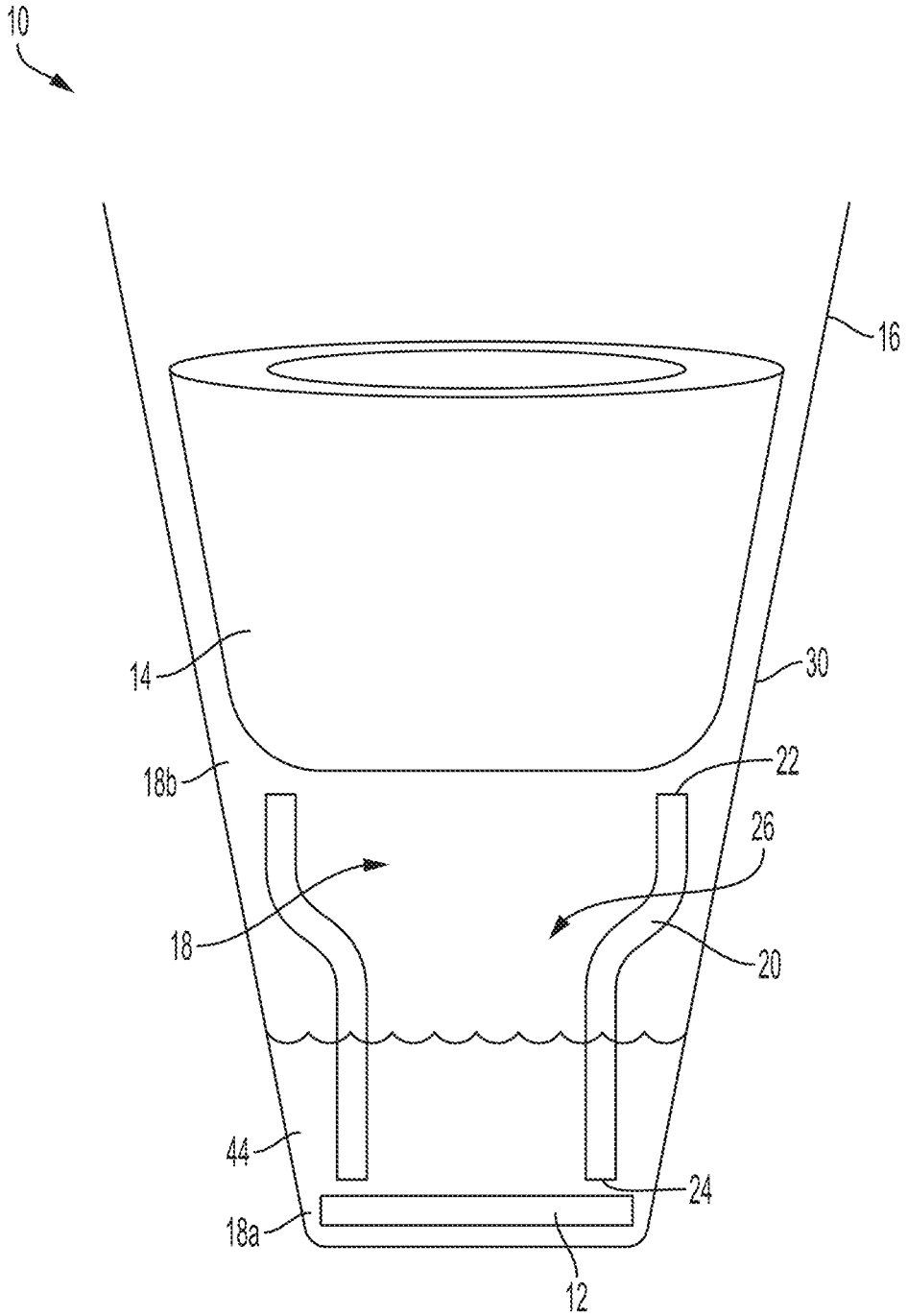
FIG. 2 is a cross section of a system for providing a hot towel as disclosed herein.
Figure 3:
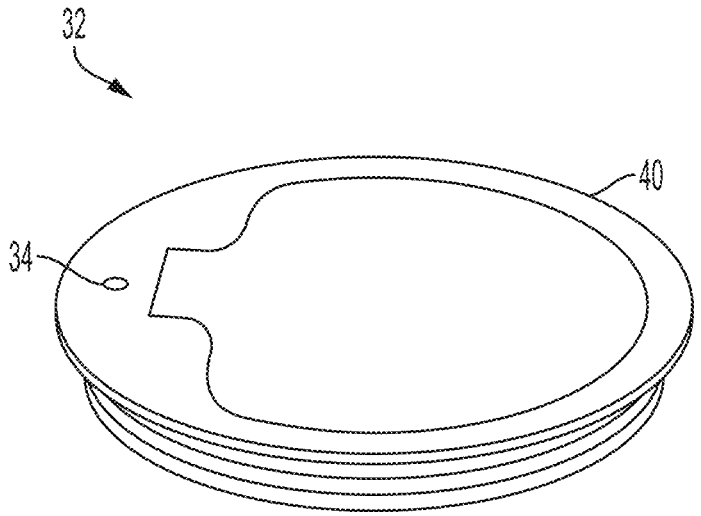
FIG. 3 is a perspective view of a lid of a container for the system as disclosed herein, with a cover of the lid in a first position.
Figure 4:
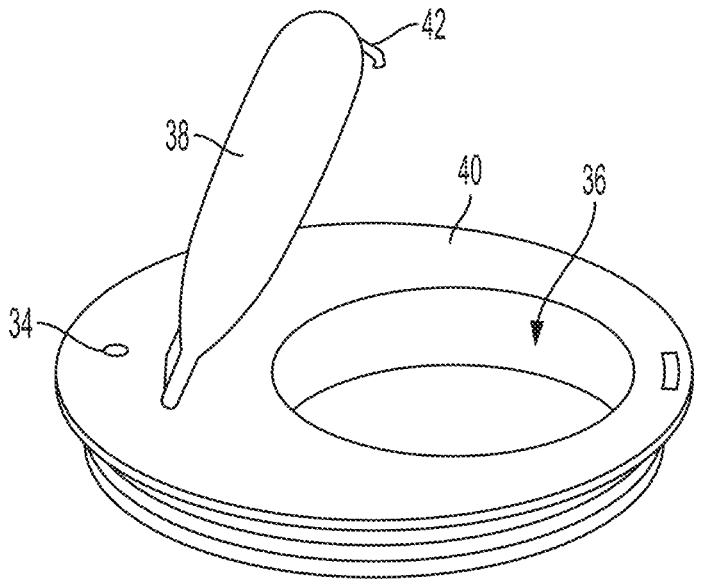
FIG. 4 is a perspective view of the lid as in FIG. 3 with the lid in a second position.
Figure 7:
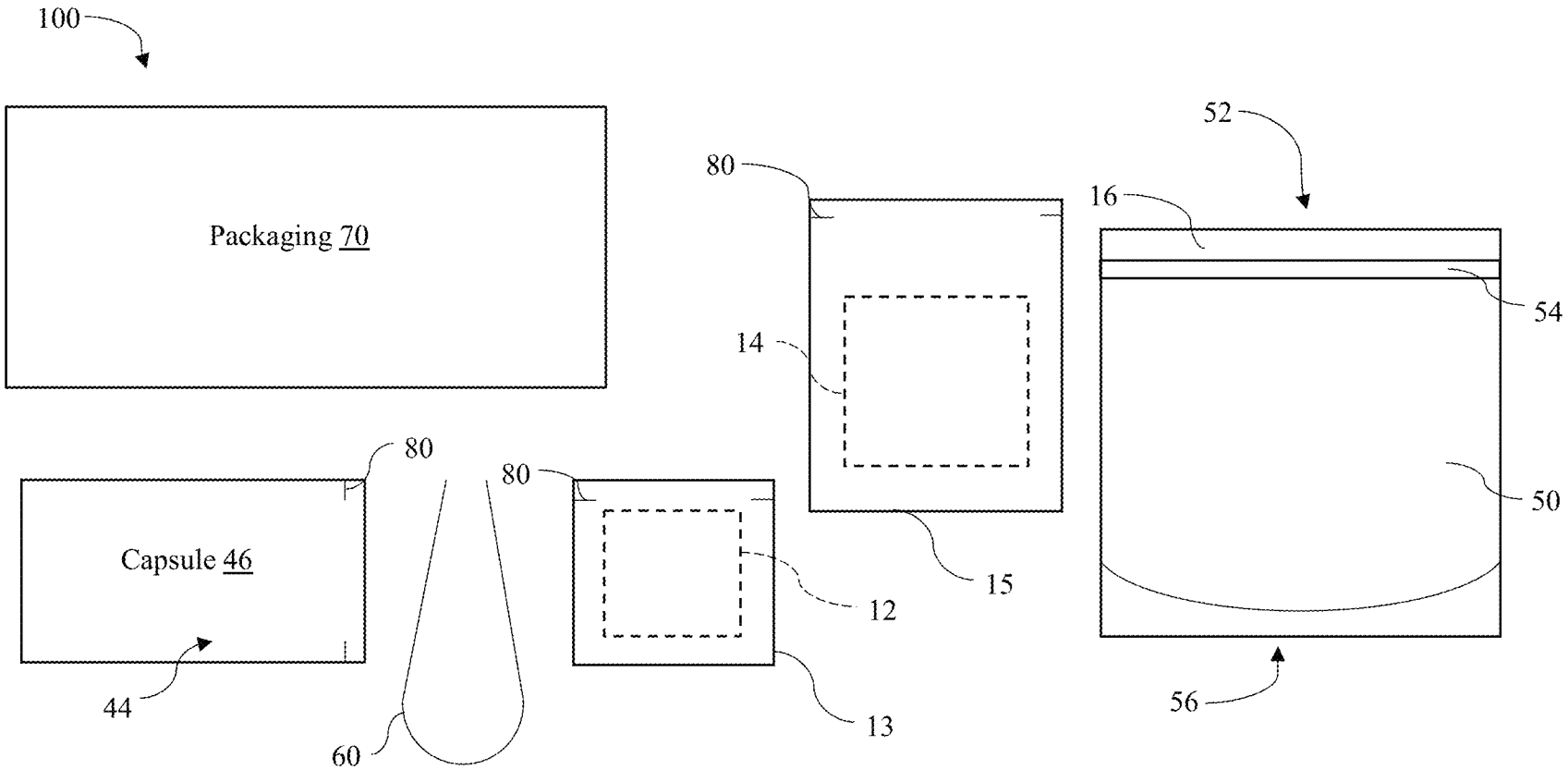
FIG. 7 is a schematic drawing of a kit as disclosed herein.
Figure 8:
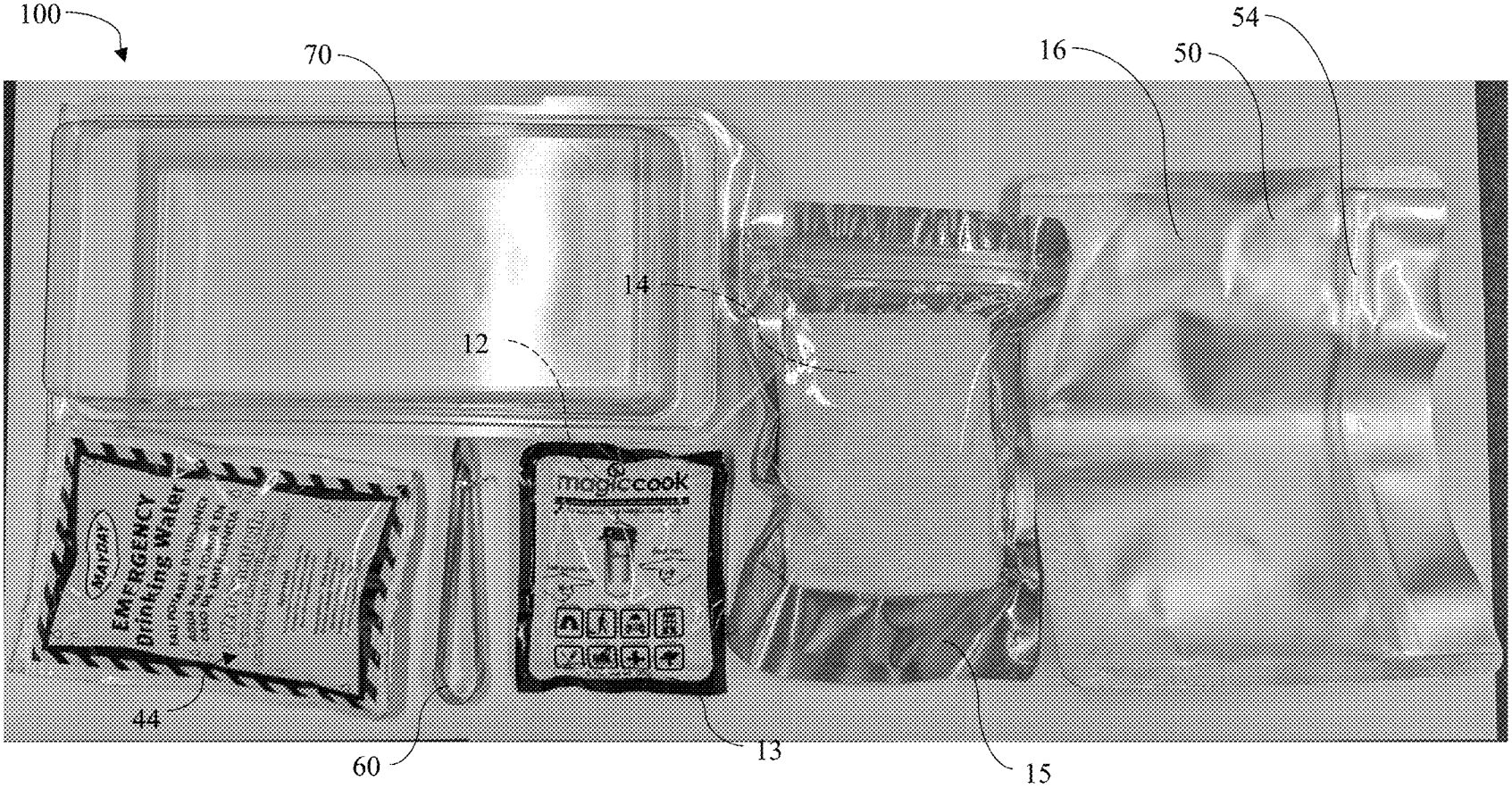
FIG. 8 is a perspective view of the kit of FIG. 7.

Referring to FIGS. 7-8, in some aspects, a kit 100 can comprise a towel 14 and a water-activated heating element 12. In further aspects, the kit 100 can further comprise the container 16 as disclosed herein. For example, in some optional aspects, the kit 100 can be provided with the towel and water-activated heating element within the container. In still further optional aspects, the kit 100 can further comprise the spacer 20 (FIGS. 2 and 5). In yet further aspects, the kit 100 can comprise the quantity of water in the pre-use condition (e.g., in a capsule). In some optional aspects, the kit 100 can comprise packaging 70 (e.g., a clamshell case) within which other elements of the kit are contained.

As illustrated in FIGS. 7-8, an exemplary kit 100 can comprise a water-activated heating element 12, a towel 14, a container 16 (e.g., a pouch 50), and a quantity of water 44 within a bag or other capsule 46. The water-activated heating element 12 can comprise airtight packaging 13. Similarly, in some optional aspects, the towel 14 can be provided in packaging 15 to keep the towel sanitary. The kit 100 can further comprise the utensil 60 (e.g., tongs) for removing the hot towel from the container 16. The kit 100 can further comprise instructions for using the kit. Each of the water-activated heating element 12, towel 14, container 16, utensil 60, quantity of water 44 in the capsule 46, and utensil 60 can be contained within the packaging 70. In some aspects, each of the capsule 44 (e.g., bag) containing the quantity of water 44, the airtight packaging 13, and the packaging 15 can comprise one or more tear notches or perforations 80 to permit respective opening thereof.

In one exemplary aspect, to use the kit 100, the towel 14 can be removed from the packaging 15. The water-activated heating element 12 can be removed from the airtight packaging 13. The water-activated heating element 12 can optionally be wrapped within the towel 14. The towel 14 and water-activated heating element 12 can be inserted into the container 16 (e.g., the pouch 50), optionally, with the water-activated heating element 12 wrapped within the towel 14. The quantity of water 44 (e.g., about 120 mL) can be poured into the container (e.g., pouring over the towel 14 to evenly wet the towel). The container 16 can be closed. For example, the closure 54 can be pinched shut. After waiting a predetermined time (e.g. about 1 minute to about 2 minutes), the towel can be removed (e.g., using the tongs or other utensil 60).

EXEMPLARY ASPECTS

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A system comprising:

a container defining an interior;

a towel disposed within the interior of the container; and a water-activated heating element disposed within the interior of the container.

Aspect 2: The system of aspect 1, further comprising water in the container.

Aspect 3: The system of aspect 2, wherein the water is in a pre-use condition in which the water is water is sealed within a capsule and separated from the water-activated heating element.

Aspect 4: The system of aspect 2, wherein the water is in a use condition that is in contact with the water-activated heating element.

Aspect 5: The system of any one of the preceding aspects, wherein the towel comprises terrycloth or microfiber or a combination thereof.

Aspect 6: The system of any one of the preceding aspects, wherein the water-activated heating element comprises magnesium, iron, and a salt.

Aspect 7: The system of any one of the preceding aspects, wherein the water-activated heating element has a mass of at least 20 grams.

Aspect 8: The system of any one of the preceding aspects, wherein the container comprises a vessel and a lid.

Aspect 9: The system of aspect 8, wherein the vessel is a double walled insulated vessel.

Aspect 10: The system of aspect 8 or aspect 9, wherein the vessel and lid threadedly couple together.

Aspect 11: The system of any one of aspects 8-10, wherein the lid defines an aperture that is configured to vent steam.

Aspect 12: The system of any one of aspects 8-11, wherein the lid defines a top opening, wherein the lid comprises a cover that is pivotable between a first position that covers the top opening and a second position that is pivoted away from the top opening.

Aspect 13: The system of aspect 12, wherein the system further comprises a latch that is configured to inhibit movement of the cover from the first position.

Aspect 14: The system of any one of the preceding aspects, wherein the system comprises a spacer, wherein the spacer divides the container between a water-activated heating element space to a towel space, wherein the spacer defines at least one opening that is configured to allow steam to move from the water-activated heating element space to the towel space.

Aspect 15: The system of aspect 14 or aspect 15, wherein the spacer comprises polyvinylchloride (PVC).

Aspect 16: The system of any one of aspects 14-16, wherein the spacer defines a lower end, an upper end, and a central opening extending between the lower end and the upper end, wherein towel biases against the upper end of the barrier.

Aspect 17: The system of any one of aspects 1-7, wherein the container comprises a pouch.

Aspect 18: The system of aspect 17, wherein the pouch has an expandable base that permits the pouch to stand up.

Aspect 19: The system of aspect 17 or aspect 18, wherein the pouch has an opening and a press seal zipper closure that is configured to close the opening.

Aspect 20: The system of any one of the preceding aspects, wherein the system further comprises a spacer that is configured to space the towel from the water-activated heating element.

Aspect 21: The system of any one of the preceding aspects, wherein the system further comprises a utensil for removing the towel from the container.

Aspect 22: The system of aspect 21, wherein the utensil comprises a pair of tongs.

Aspect 23: The system as in any one of the preceding aspects, wherein the towel is moist.

Aspect 24: The system as in any one of the preceding aspects, wherein the towel is impregnated with at least one additive.

Aspect 25: The system of aspect 24, wherein the at least one additive comprises a moisturizer.

Aspect 26: A method comprising:

activating a water-activated heating element in a container to heat a towel in the container.

Aspect 27: The method of aspect 26, wherein activating the water-activated heating element in the container to heat the towel in the container comprises:

pouring a first quantity of water into the container to contact the water-activated heating element; and placing the towel in the container.

Aspect 28: The method of aspect 27, wherein the method further comprises removing the towel from the container prior to pouring water into the container.

Aspect 29: The method of aspect 27 or aspect 28, wherein the first quantity of water is at least 40 milliliters.

Aspect 30: The method of aspect 29, wherein the first quantity of water is about 50 milliliters.

Aspect 31: The method of any one of aspects 27-30, wherein the method further comprises adding a second quantity of water onto the towel.

Aspect 32: The method of any one of aspects 27-31, wherein the method further comprises removing the towel from the container.

Aspect 33: The method of aspect 32, wherein the method further comprises waiting at least three minutes after pouring the first quantity of water into the container before removing the towel.

Aspect 34: The method of aspect 33, wherein at least waiting three minutes comprises waiting about five minutes.

Aspect 35: The method of any one of aspects 27-24, wherein removing the towel from the container comprises using tongs to remove the towel from the container.

Aspect 36: The method of any one of aspects 32-35, wherein removing the towel comprises removing the towel after at least a portion of the towel has reached a temperature above 120° F.

Aspect 37: The method of any one of aspects 27-36, further comprising:

emptying substantially all water from the container;

pouring a third quantity of water into the container; and positioning the towel in the container.

Aspect 38: The method of aspect 37, further comprising replacing the water-activated heating element with a replacement water-activated heating element.

Aspect 39: A kit comprising:

a towel; and at least one water-activated heating element.

Aspect 40: The kit of aspect 39, wherein the system further comprises a container defining an interior.

Aspect 41: The kit of aspect 40, wherein each of the towel and the water-activated heating element are disposed within the interior of the container.

Aspect 42: The kit of any one of aspects 39-41, wherein the at least one water-activated heating element comprises a plurality of water-activated heating elements.

Aspect 43: The kit of any one of aspects 39-42, further comprising a quantity of water within a capsule.

Aspect 44: A kit comprising all elements of the system as in any one of aspects 1-25.

Although the foregoing invention has been described in some detail by way of illustration and example for purposes of clarity of understanding, certain changes and modifications may be practiced within the scope of the appended claims.

What is claimed is:

1. A system comprising:

a container defining an interior;

a towel disposed within the interior of the container; and a water-activated heating element disposed within the interior of the container, wherein portions of the interior occupied by the towel and the water-activated heating element are in fluid communication to permit steam generated by the water activated heating element to contact the towel.

2. The system of claim 1, further comprising water in a pre-use condition in which the water is water is sealed within a single use bag and separated from the water-activated heating element.

3. The system of claim 1, wherein the towel comprises terrycloth or microfiber or a combination thereof.

4. The system of claim 1, wherein the water-activated heating element comprises magnesium, iron, and a salt.

5. The system of claim 1, wherein the water-activated heating element has a mass of at least 20 grams.

6. The system of claim 1, wherein the container comprises a pouch having a press-seal zipper closure.

7. The system of claim 6, wherein the pouch has an expandable base that permits the pouch to stand up.

8. The system of claim 6, wherein the pouch has an opening and a press seal zipper closure that is configured to close the opening.

9. The system of claim 1, wherein the system further comprises a utensil for removing the towel from the container.

10. The system of claim 9, wherein the utensil comprises a pair of tongs.

11. The system of claim 1, wherein the towel is moist.

12. The system of claim 1, wherein the towel is impregnated with at least one additive.

13. A kit comprising:

a towel;

at least one water-activated heating element; and a container defining an inner volume that is configured to simultaneously receive the towel and the at least one water-activated heating element so that steam generated by the at least one water-activated heating element can be absorbed by the towel.

14. The system of claim 1, wherein the towel has a width from about 6 inches to about 24 inches and a length from about 6 inches to about 24 inches.

15. The system of claim 1, further comprising a spacer that is configured to be positioned within the interior of the container between the water-activated heating element and the towel to maintain a spaced relationship between the water-activated heating element and the towel.

16. A method comprising:

pouring a first quantity of water into an interior of a container to activate a water-activated heating element disposed within the interior of the container; and allowing steam generated from the water-activated heating element to contact a towel in the interior of the container.

17. The method of claim 16, further comprising wrapping the water-activated heating element in the towel, wherein placing the towel in the container comprises placing the towel within the container with the water-activated heating element wrapped therein, wherein pouring the first quantity of water into the container to contact the water-activated heating element comprises pouring the water onto the towel with the water-activated heating element wrapped therein.

18. The method of claim 16, wherein the container is a pouch, wherein the interior of the container is a pocket defined by the pouch, wherein the method further comprises placing the towel and the water-activated heating element in the pocket of the pouch.

19. The kit of claim 13, wherein the at least one water-activated heating element comprises a plurality of water-activated heating elements.

20. The kit of claim 13, wherein the container is a pouch, wherein the interior of the container is a pocket defined by the pouch, wherein the system further comprises:

packaging;

and water in a pre-use condition in which the water is sealed within a capsule and separated from the water-activated heating element, wherein each of the towel, the at least one water-activated heating element, the container, and the water is disposed within the packaging.

* * * * *